US010588196B2

(12) United States Patent
Zou

(10) Patent No.: US 10,588,196 B2
(45) Date of Patent: Mar. 10, 2020

(54) LIGHTING LOAD ABNORMALITY DETECTING DEVICE AND CORRESPONDING LIGHTING SYSTEM

(71) Applicants: Self Electronics Co., Ltd., Ningbo, Zhejiang (CN); Wanjiong Lin, Ningbo, Zhejiang (CN); Self electronics USA Corporation, Norcross, GA (US)

(72) Inventor: Xuejun Zou, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 16/401,581

(22) Filed: May 2, 2019

(65) Prior Publication Data

US 2019/0342971 A1 Nov. 7, 2019

(30) Foreign Application Priority Data

May 2, 2018 (CN) ..... 2018 1 0407433

(51) Int. Cl.
*H05B 33/08* (2006.01)
*H05B 37/03* (2006.01)

(52) U.S. Cl.
CPC ..... *H05B 33/0887* (2013.01); *H05B 33/0845* (2013.01); *H05B 37/03* (2013.01)

(58) Field of Classification Search
CPC . H05B 37/03; H05B 33/0887; H05B 33/0845
See application file for complete search history.

(56) References Cited

U.S. PATENT DOCUMENTS

2012/0293082 A1* 11/2012 Huang ..... H05B 33/089 315/192
2016/0192456 A1* 6/2016 Su ..... H05B 33/0815 315/309
2017/0006683 A1* 1/2017 Shiyu ..... H05B 33/0851
2017/0150572 A1* 5/2017 Zhang ..... H05B 33/0815
2018/0184496 A1* 6/2018 Pilz ..... H05B 33/0869
2019/0245432 A1* 8/2019 Yan ..... H02J 7/0052

FOREIGN PATENT DOCUMENTS

JP 2015044423 A * 3/2015

* cited by examiner

*Primary Examiner* — Raymond R Chai
(74) *Attorney, Agent, or Firm* — Wang Law Firm, Inc.

(57) ABSTRACT

The invention relates to a lighting load abnormality detecting device, the device including a power supply module, which is configured to provide power supply for the detecting device and the lighting load connected with the detecting device; a detecting circuit is configured to detect the abnormal state of the lighting load; a control module is configured to judge whether the lighting load is abnormal or not according to the detecting circuit feedback detection information; the detecting circuit includes a parallel PWM detection circuit and a static detection circuit; the static detecting circuit is configured to independently detect anomalies when the abnormality detecting device has no pulse loading or to cooperate with the pulse width modulation detecting circuit to jointly detect anomalies when there is pulse loading.

6 Claims, 4 Drawing Sheets

LIGHTING LOAD ABNORMALITY DETECTING DEVICE AND CORRESPONDING LIGHTING SYSTEM

RELATED APPLICATION

This application claims priority to a Chinese Patent Application No. CN 201810407433.7, filed on May 2, 2018.

FIELD OF THE TECHNOLOGY

The present invention relates to electronic equipment field, with particular emphasis on a lighting load abnormality detecting device and corresponding lighting system.

BACKGROUND OF THE INVENTION

Lighting equipment, such as existing constant voltage dimming LED light control devices, mostly use PWM control output, that is, after the LED light is connected to the power supply, the brightness of the light is determined by the PWM duty cycle, even dimming LED light controllers with digital addressable lighting interfaces are no exception.

However, in the current LED lamp control device, when there is no PWM pulse output, it is impossible to sense whether the lamp in the device is well wired or the lamp is faulty, that is, the load abnormality in the control device cannot be perceived, especially in the start-up phase is more prone to this problem.

In order to solve the above problem, the operator often judges the abnormality by inputting a large pulse to the control device, particularly in the startup phase, and detecting the return current value of the LED lamp load as example. However, on the one hand, when the load is light, the return current value is small, so that the circuit may not be detected, causing misjudgment; on the other hand, due to sudden input of a large pulse, for example, the load of the LED lamp suddenly flickers, causing the operator is not working properly. In addition, with the improvement of lighting load requirements for LED lamps and the like, it is also necessary to accurately record and report the fault status of the lamp in time, and the existing lighting device cannot achieve this function.

BRIEF SUMMARY OF THE INVENTION

Therefore, the present invention provides a lighting load abnormality detecting device, which has the advantages of no pulse width output and timely detection of load abnormality, that is, the load abnormality can be effectively judged at the startup stage of the lighting device, and the double verification effect can be realized by combining the previous pulse width modulation, has a good boot effect.

It is still another object of the present invention to provide a lighting load abnormality detecting device capable of recording and reporting a lighting load abnormality.

It is still another object of the present invention to provide an lighting system having the above-described abnormality detecting device.

In order to achieve the above object, the technical solution adopted by the present invention is: a lighting load abnormality detecting device, and the device includes a power supply module being configured to provide power to the detecting device and lighting load connected to the detecting device;

a detecting circuit being configured to detect an abnormal state of the lighting load;

a control module being configured to judge whether the lighting load is abnormal or not according to the detection information fed back by the detecting circuit;

characterized in that:

the detecting circuit includes a pulse width modulation detecting circuit and a static detecting circuit in parallel;

the static detecting circuit being configured to detect abnormalities independently when the lighting load abnormality detection device is not loaded with pulses or jointly detect abnormalities with the pulse width modulation detection circuit when there is pulse loading.

Advantageously, the static detection circuit has a high resistance resistor connected to first input of the control module and a lighting load module.

Advantageously, the pulse width modulation detecting circuit includes a field effect transistor and an amplifier for amplifying an output of the field effect transistor;

the output of the field effect transistor is amplified and fed back to second input of the control module;

the pulse control signal of the pulse width modulation detection circuit is provided by the control module.

Advantageously, the detecting device further includes a DALI interface circuit connected to the output end of the control module to record and report abnormal states;

the control module is connected to the power supply module through a DALI module power supply circuit.

Advantageously, the power supply module is a low voltage power supply module or the power supply module is formed by the commercial power after passing through in sequence electromagnetic interference filter circuit, rectification filter circuit, power factor correction circuit, and DC/DC conversion circuit.

A lighting system, characterized in that: the lighting system adopts the lighting load abnormal detecting device; the system also includes a lighting load module connected with the lighting load abnormality detecting device.

Advantageously, the lighting load module is an LED lighting module.

Compared with the prior art, the invention has the advantages that: on the basis of the previous PWM control detection circuit, a static detection circuit is added, so that when the circuit is started, even if the circuit does not load pulse, the abnormal lighting load can be judged according to the change of the input signal of the control module; at the same time, the static detecting circuit can complement the PWM control detecting circuit to check whether the other side's judgment is correct or not; In addition, the static detection circuit can be combined with the PWM control detection circuit to judge the load abnormalities in the operation process of the circuit, so as to further improve the accuracy of the abnormal judgment.

BRIEF DESCRIPTION OF THE DRAWINGS

The drawings described herein are intended to promote a further understanding of the present invention, as follows.

DETAILED DESCRIPTION OF THE INVENTION

The present application is illustrated by way of the following detailed description based on of the accompanying drawings. It should be noted that illustration to the embodiment in this application is not intended to limit the invention.

Figure 1:
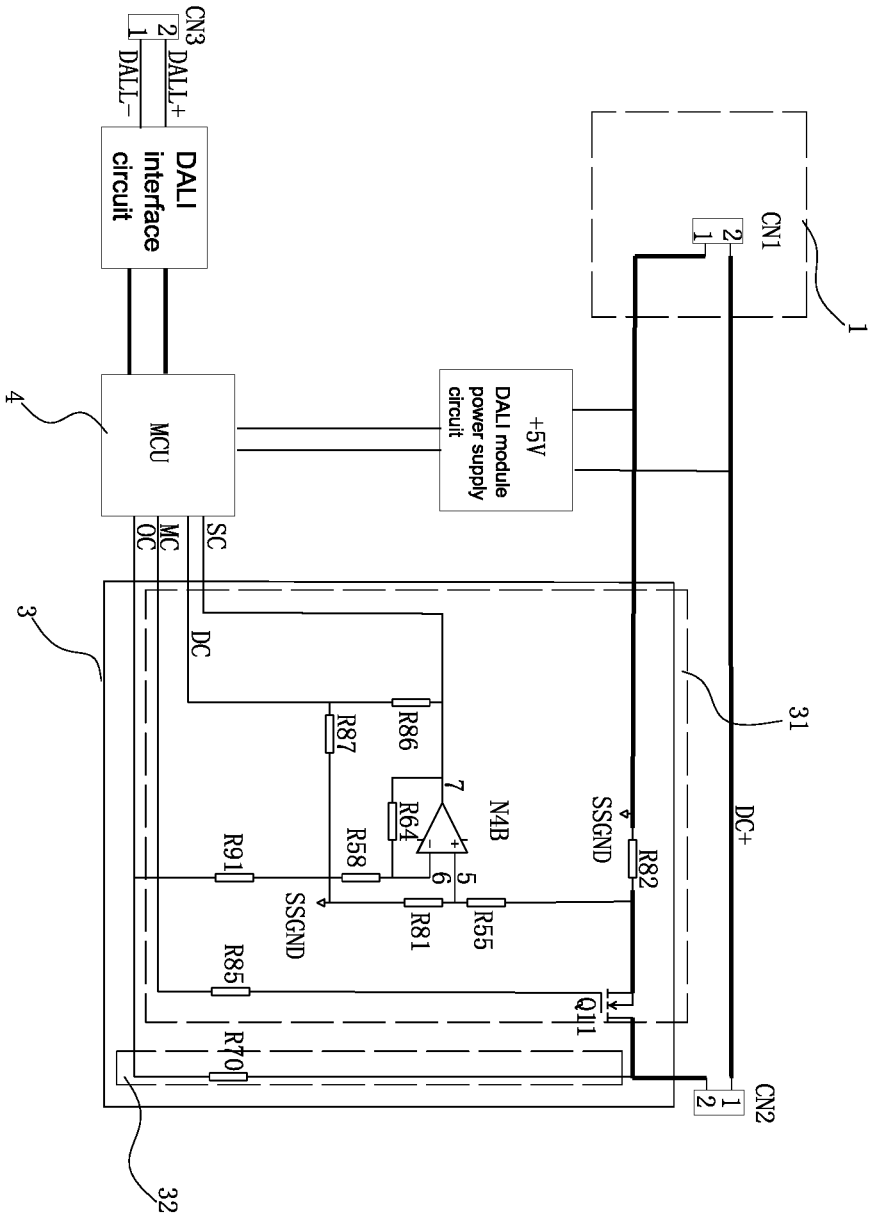
FIG. 1 is a circuit diagram of a lighting load abnormality detecting device according to an embodiment of the present invention.
Figure 2:
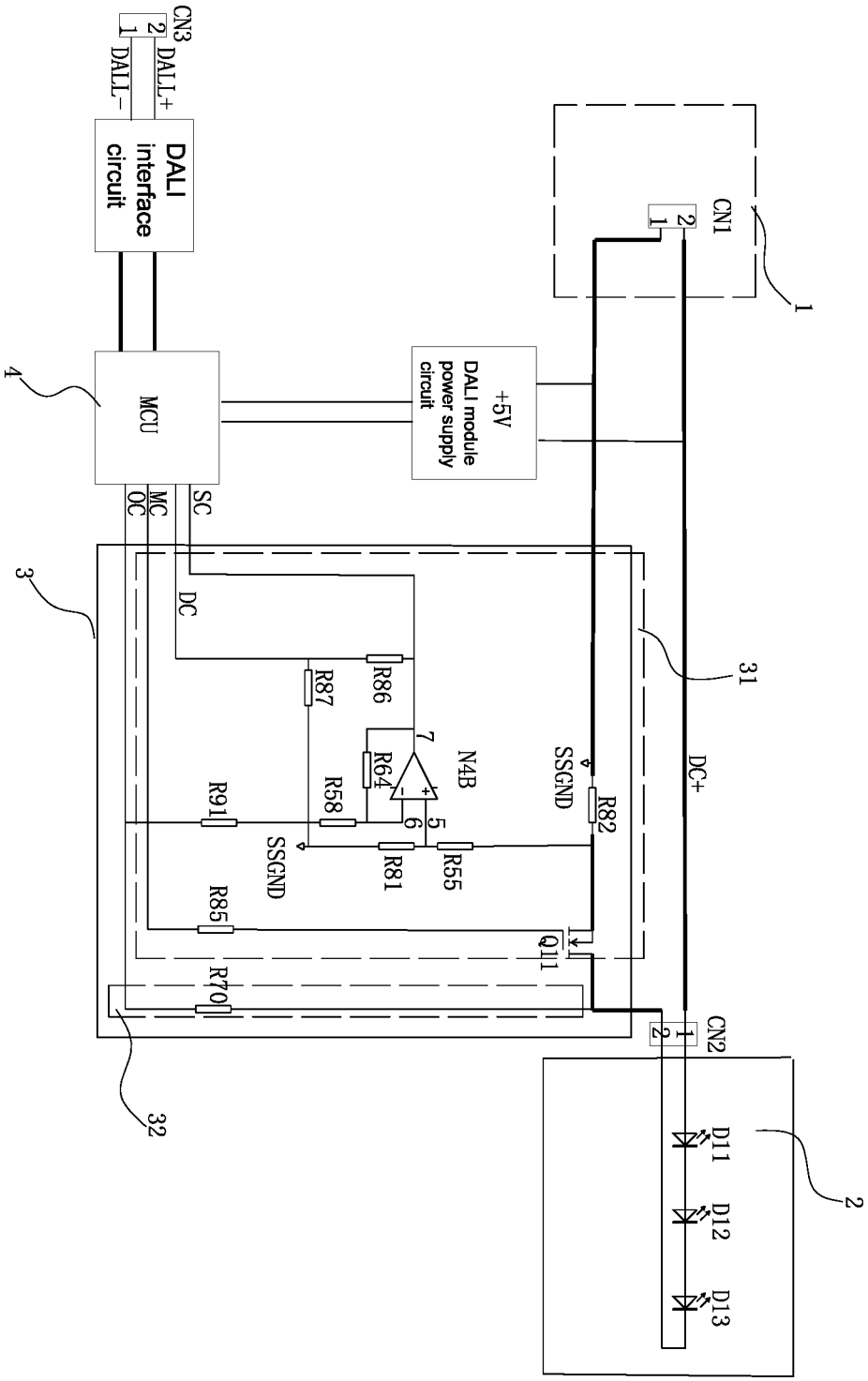
FIG. 2 is a lighting system circuit diagram formed after connecting the lighting load in FIG. 1.
Figure 3:
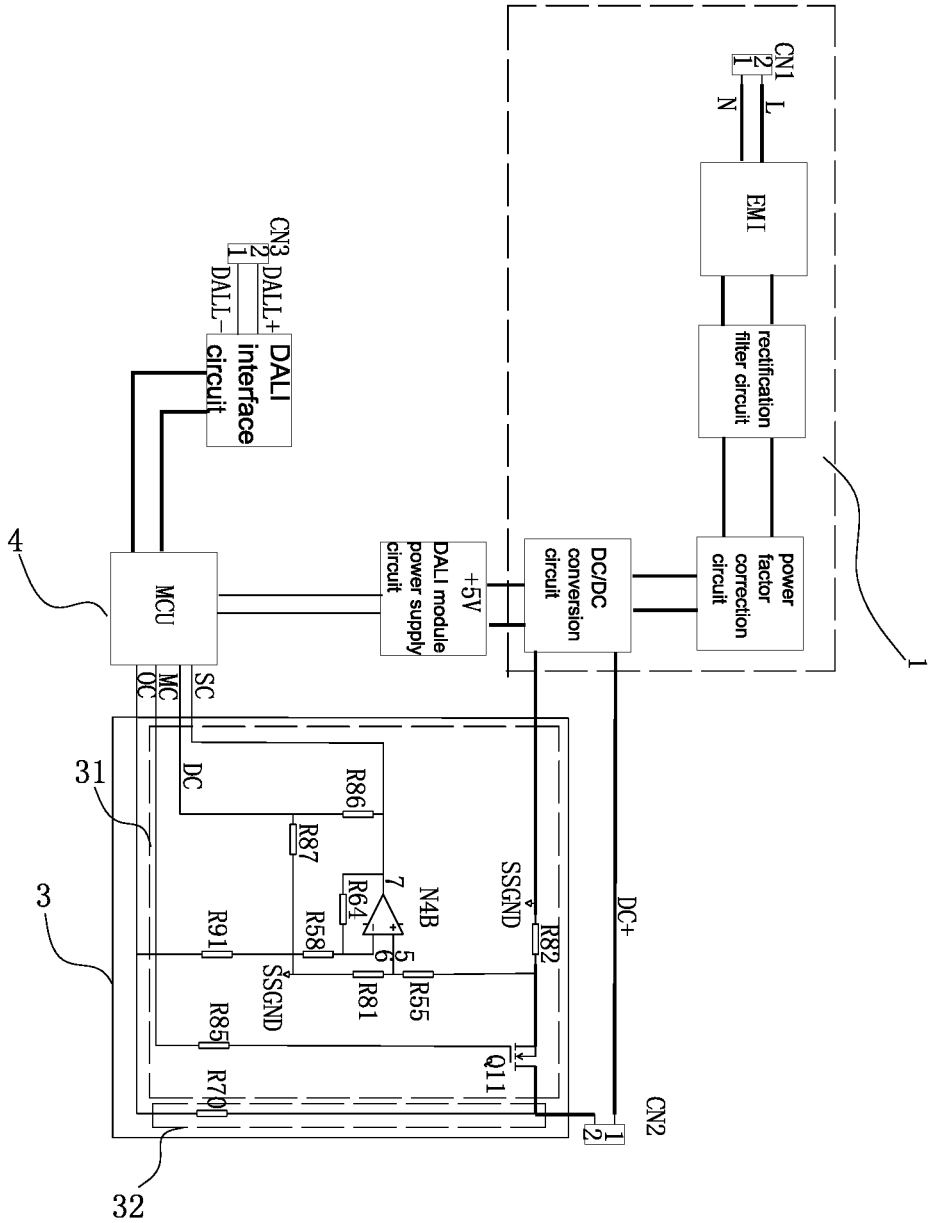
FIG. 3 is a circuit diagram of a lighting load abnormality detecting device according to another embodiment of the present invention.
Figure 4:
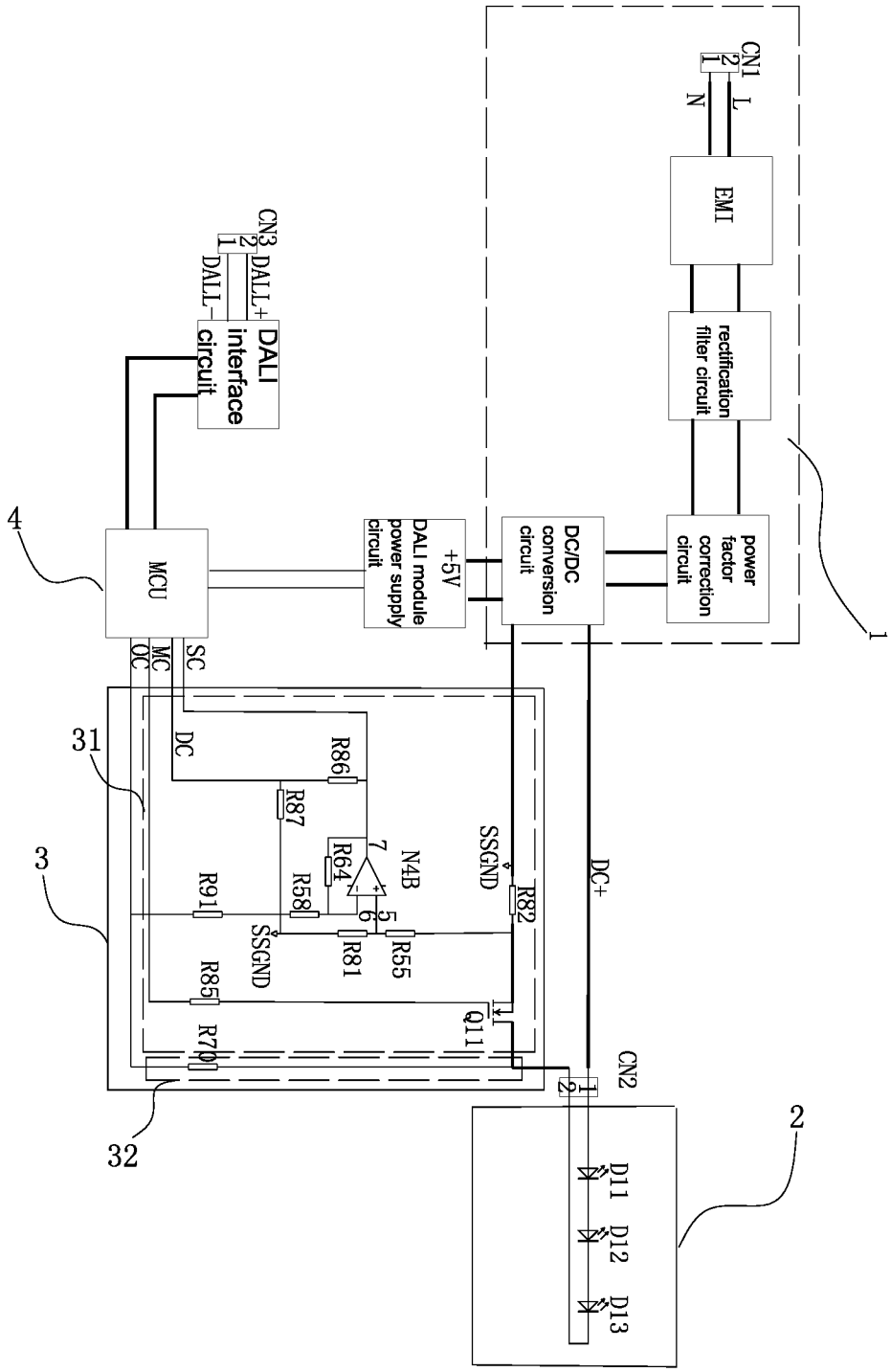
FIG. 4 is a lighting system circuit diagram formed after connecting the lighting load in FIG. 3.

FIG. 1 and FIG. 3 are schematic diagrams showing two circuit configurations of the lighting load abnormality detecting device of the present invention, However, it should be noted that this application not only corresponds to the above two structures, but also other structures that can realize the purpose of this application are included in the scope of this application, and only the circuit of two lighting load abnormality detection devices shown in FIG. 1 and FIG. 3 and the corresponding lighting system shown in FIG. 2 and FIG. 4 are described here.

Embodiment 1 is as follows:

A lighting load abnormality detecting device as shown in FIG. 1 includes power supply module 1, detecting circuit 3, and control module 4. The rear end of the detecting circuit 3 can be connected to lighting load or other loads, and can detect whether the lighting load is well connected with the front-end circuit or whether the lighting load itself is good, and judge the result by the response of the front-end control module, and this does not require the operator to perform on-site inspection, which greatly improves the work efficiency of the operator.

In this embodiment, the power supply module 1 supplies power to the lighting load abnormality detecting device, and also supplies power to the lighting load connected to the detecting circuit 3, as shown in the lighting system in FIG. 2.

The detecting circuit 3 detects an abnormal state of the lighting load module 2. Specifically, the detecting circuit 3 includes pulse width modulation detecting circuit 31 and static detecting circuit 32. The pulse width modulation detecting circuit 31 and the static detecting circuit 32 are connected in parallel, and both are connected to the lighting load module 2 and the control module 4.

The static detection circuit 32 is configured to detect abnormalities independently when the lighting load abnormality detection device is not loaded with pulses or jointly detect abnormalities with the pulse width modulation detection circuit 31 when there is pulse loading, The control module 4 judges whether the lighting load module 2 is abnormal or not according to the feedback detection information of the detection circuit 3.

The pulse width modulation detection circuit 31 can be a combination of an enhanced n-channel MOS transistor and an op-amp, or any other device combination that can be modulated through PWM. The static detection circuit 32 may be a branch formed by a high resistance state resistance, as is the case in this embodiment; of course, this embodiment is not limited to this. The static detection circuit 32 may also be a detection branch formed by other devices or device combinations having a high resistance state and not affected by PWM.

In this embodiment, the drain of the enhanced N-channel MOS transistor Q11 of the pulse width modulation detecting circuit 31 is connected to the lighting load module 2, the source of the enhanced N-channel MOS transistor Q11 is connected to the power supply module 1 through the resistor R82 and is connected to the operational amplifier N4B through the resistor R55. The output end of the operational amplifier N4B is connected to the second input end SC of the control module 4. At the same time, the output end of the operational amplifier N4B is further connected to the third input end DC of the control module 4 through a resistor R86 for transmitting a short-circuit trigger signal, and the grid of the enhanced N-channel MOS transistor Q11 is connected to the first output end MC of the control module 4 through the resistor R55 for receiving the PWM pulse signal; the static detecting circuit is connected with the drain of MOS transistor and the first input end OC of the control module 4 by high resistance value resistor R70.

In the circuit starting phase, the MOS transistor is not loaded with pulses, so it is in the off state. At this time, only the lighting load module forms a loop through the static detection branch R70. If the lamp contacts well and normal, the drain of the MOS transistor has a higher level. At the same time, the first input end OC of the control module 4 also detects a high level after passing through the resistor R70, and since R70 is a high resistance value resistor, the current flowing through the lamp is extremely small, which is insufficient for the lamp to illuminate. Therefore, it is possible to avoid the problem that the abnormality is detected by loading a large pulse in the past, causing the lamp to flicker and cause discomfort; if the lamp is connected abnormally or the lamp is abnormal, the drain level of the MOS transistor tends to be 0 V, and the first input end OC of the control module 4 detects a low level through the resistor R70, thus, the quality of the lamp contact can be easily judged by the level signal of the first input end OC of the control module 4.

After the circuit is completely started, the control module 4 loads the pulse signal for the MOS transistor, and the MOS transistor conducts. When the lamp is in normal or good contact, a relatively large current flows through the sampling resistor R82 to form a certain voltage, and is amplified by the amplifier N4B and transmitted to the control module. 4, that is, the current sampling signal is amplified by the amplifier and transmitted to the control module 4 by the port SC; if the lamp is abnormal, no current flows through the sampling resistor R82, or only a very small sampling analog signal enters the control module 4 via the port SC; If the lamp is short-circuited, a relatively maximum current flows through the sampling resistor R82 to form a certain voltage, and is amplified by the amplifier to form a load short-circuit trigger signal, which is transmitted to the third input end DC of the control module 4 via the resistor R87. In either case, in the MOS transistor on state, after receiving the analog signals output by PWM detection circuit, the control module 4 will analyze and process them, and judge the current state of lighting load based on the analysis and processing results. Meanwhile, it will give feedback to indicate the operator in the operation center whether the load is abnormal or not.

When the MOS transistor is in the conduction state, the drain of the MOS transistor has a lower level. At this time, the static detection circuit is in a suppressed state. Therefore, during the operation of the lighting load abnormality detecting device, the abnormality detection is mainly performed by the PWM detecting circuit. After the pulse is over, when the MOS transistor is in the off state, the static detection branch will continue to perform the detection function according to the detection mode before the start, so that when the pulse is loaded, the static detection branch can cooperate with the PWM detection branch to perform an abnormality detection on the lamp at the same time. Therefore, regardless of whether or not the Q11 is on, the lighting load abnormality detecting device can detect the abnormality of the lighting load, thereby improving the applicability of the detecting device.

It can be found from the above operation process that from the start-up stage to the complete operation of the circuit, it will undergo the transformation from static detection branch to PWM detection circuit, Thus, the detection device can also compare the detection results of two detection branches. In this way, it can judge whether the conclusion is correct that the lamp is abnormal at the beginning of circuit start-up, that is, double verification can be achieved, thereby improving the accuracy of the judgment.

In order to save the judgment information and report it accurately when the DALI controller comes to inquire, the output end of the control module is connected with DALI interface circuit, and the control module 4 is connected to the power supply module through the DALI module power supply circuit. And the power supply module 1 is mainly powered by a low voltage module.

Embodiment 2 is as follows:

The second embodiment mainly improves the power supply module of the first embodiment, as shown in FIG. 3 and FIG. 4. Therefore, only the improvement points are described herein, and the rest is the same as the first embodiment, and details are not described herein again.

In order to improve the application range of the detecting device, FIG. 3 shows that the power supply module 1 is formed by the commercial power after passing through in sequence electromagnetic interference filter circuit, rectification filter circuit, power factor correction circuit, and DC/DC conversion circuit. Of course, the processing module of the commercial power can also be a combination of other functional modules that can convert the commercial power into a stable direct current, and it will not be enumerated here.

It should be mentioned that the lighting load module in the detecting device can be any lighting device, such as an LED lighting module. FIG. 4 corresponds to a lighting system employing such a detection device.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

What is claimed is:

1. A lighting load abnormality detecting device, the device comprising:

a power supply module (1) being configured to provide power to the detecting device and lighting load connected to the detecting device;

a detecting circuit (3) being configured to detect an abnormal state of the lighting load;

a control module (4) being configured to judge whether the lighting load is abnormal or not according to the detection information fed back by the detecting circuit (3);

characterized in that:

the detecting circuit (3) includes a pulse width modulation detecting circuit (31) and a static detecting circuit (32) in parallel;

the static detecting circuit (32) being configured to detect abnormalities independently when the lighting load abnormality detecting device is not loaded with pulses or jointly detect abnormalities with the pulse width modulation detection circuit (31) when there is pulse loading;

wherein the pulse width modulation detecting circuit includes a field effect transistor and an amplifier for amplifying an output of the field effect transistor;

the output of the field effect transistor is amplified and fed back to a second input of the control module; and a pulse control signal of the pulse width modulation detection circuit is provided by the control module.

2. The lighting load abnormality detecting device as claimed in claim 1, wherein the static detection circuit (32) has a resistor connected to first input of the control module (4) and a lighting load module (2).

3. The lighting load abnormality detecting device as claimed in claim 1, wherein the detecting device further includes a digital addressable lighting interface (DALI) circuit connected to the output end of the control module (4) to record and report abnormal states;

the control module (4) is connected to the power supply module (1) through a DALI module power supply circuit.

4. The lighting load abnormality detecting device as claimed in claim 1, wherein the power supply module (1) is a power supply module or is formed by commercial power after passing through in sequence electromagnetic interference filter circuit, rectification filter circuit, power factor correction circuit, and DC/DC conversion circuit.

5. A lighting system, characterized in that: the lighting system adopts the lighting load abnormal detecting device as described in claim 1;

the system also includes a lighting load module (2) connected with the lighting load abnormality detecting device.

6. The lighting system as claimed in claim 5, wherein the lighting load module (2) is an LED lighting module.

* * * * *